US005871067A

United States Patent [19]

Parenti

[11] Patent Number: 5,871,067

[45] Date of Patent: Feb. 16, 1999

[54] PERMANENTLY AFFIXED FOLDING EMERGENCY ESCAPE LADDER

[76] Inventor: Steve Parenti, 36425 Newark Blvd., Newark, Calif. 94560

[21] Appl. No.: 935,885

[22] Filed: Oct. 15, 1997

[51] Int. Cl.[6] ..... E06C 9/10

[52] U.S. Cl. ..... 182/95; 182/70; 182/163

[58] Field of Search ..... 182/95, 97, 93, 182/70, 107, 108, 163

[56] References Cited

U.S. PATENT DOCUMENTS

| | | | |
|---|---|---|---|
| 60,731 | 1/1867 | Hovey | 182/1 |
| 293,153 | 2/1884 | Downing . | |
| 1,203,313 | 10/1916 | Danke | 182/95 |
| 4,754,843 | 7/1988 | Hudenson | 182/129 |
| 5,022,491 | 6/1991 | Gill | 182/95 |

*Primary Examiner*—Alvin Chin-Shue
*Attorney, Agent, or Firm*—James P. Hillman

[57] ABSTRACT

The present invention is a collapsible, folding emergency escape ladder having an attachment means for permanently affixing it to a window frame rough opening structural components that are present within the walls of all residential housed, a retention means for securing the ladder in the folded position, and a multiplicity of swivel link means for joining the multiplicity of ladder sections to one another. The attachment means for permanently affixing the emergency escape ladder to a window sill includes a rigid framework having attachment bolts/screws apertures disposed therein at predetermined locations that line up with the inner wall structural framework found surrounding windows in most, if not all, residential dwellings. The retention means for securing the ladder in the folded position includes a pin arrangement that may cooperate with a chain for gathering the collapsed foldable sections in a compact area next to the rigid framework attachment means. A preferred embodiment of the invention dispenses with the need for the gathering chain. Both embodiments are operated by the simple release of a pin thereby allowing a panic-stricken escapee simplicity and ease of deployment. The multiplicity of swivel link means for joining the multiplicity of ladder sections to one another are discreet lengths having apertures that line up and cooperate with apertures disposed in the side rails of individual ladder sections such that a free deployment rotation occurs between individual ladder sections in a vertical direction while eliminating swivel motion between individual ladder sections in all other directions except vertical. Another preferred embodiment of the invention utilizes curvature of the top portion of the top ladder section to form an enlarged bent hook to be used as hand rails during the initial descent from the window frame to the ladder.

10 Claims, 12 Drawing Sheets

PERMANENTLY AFFIXED FOLDING EMERGENCY ESCAPE LADDER

BACKGROUND OF THE INVENTION

1. Field of the Invention

The invention relates in general to a folding emergency escape ladder and in particular to a folding emergency escape ladder having attachment means for permanent affixing/attachment to a window sill, a retention means for securing the ladder in the folded position, and a multiplicity of swivel link means for joining the ladder sections.

2. Description of the Related Art

Emergency escape steps or ladders are installed in general on commercial buildings as a matter of course, usually, if not exclusively, required by building codes. Often these escape steps include a collapsible ladder portion or other means of having at least a retractable or collapsible bottom portion to deter unauthorized use. Municipal building codes do not require emergency escape means, and consequently, they are not to be found on residential units. Residential homes above one story, and certainly above two stories, however, do often have the need for an emergency escape route when a fire, earthquake, or other emergency trap the inhabitants in a location above the first floor. A leap from even the second floor can result in serious injury. Several problems with available foldable emergency escapes make residential use unpopular. These problems largely fall into the categories of attachment means for permanently affixing the ladder, retention means for securing the ladder in the folded position, and inexpensive joint means for attaching sections of the ladder to one another.

The various collapsible emergency escape ladders disclosed in he prior art can be generally categorized as (i) portable escape ladders or (ii) permanently affixed escape ladders:

U.S. Pat. No. 3,946,834 is one example of (i) in that it is a self-storing, portable fire escape ladder that includes an enlarged hook means for engaging a window sill or similar structure during use. This type of portable ladder is not suitable for use in a residential emergency because without sufficient practice, high stress and panic due to the emergency would interfere with correct deployment of the ladder such that it securely affixes to the window sill. Another drawback of this design of a portable emergency escape ladder is the complicated arrangement of pivotably interconnected rung ladder sections, whose arrangement is costly for residential use.

U.S. Pat. No. 5,022,491 is one example of (ii) in that it is a permanently affixed escape ladder that includes an exit platform having an exit opening formed at the distal end of the platform to facilitate safe access to the unfolded ladder sections. This patent also includes a plurality of folding ladder sections that are retained in the folded position by a retractable ladder retention means that slidably engages retention posts fixedly attached to the respective ladder sections. Although this ladder is suitable for permanent attachment near an opening in the building unit, the expense of fabrication of the above described beneficial attributes make this incompatible with residential use.

SUMMARY OF THE INVENTION

Briefly, the present invention is a collapsible, folding emergency escape ladder having an attachment means for permanently affixing it to a window sill, a retention means for securing the ladder in the folded position, and a multiplicity of swivel link means for joining the multiplicity of ladder sections to one another. The attachment means for permanently affixing the emergency escape ladder to a window sill includes a rigid framework having attachment bolts/screws apertures disposed therein at predetermined locations that line up with the inner wall structural framework found surrounding windows in most, if not all, residential dwellings. The retention means for securing the ladder in the folded position includes a pin arrangement that may cooperate with a chain for gathering the collapsed foldable sections in a compact area next to the rigid framework attachment means. A preferred embodiment of the invention dispenses with the need for the gathering chain. Both embodiments are operated by the simple release of a pin thereby allowing a panic-stricken escapee simplicity and ease of deployment. Both embodiments also retain the foldable ladder sections in the collapsed position by only restraining the small deployment forces operating in a direction perpendicular to the pull of gravity, while requiring the ladder section side rails to withstand the far greater deployment forces operating in a direction parallel to the pull of gravity. The multiplicity of swivel link means for joining the multiplicity of ladder sections to one another are discreet lengths having apertures that line up and cooperate with apertures disposed in the side rails of individual ladder sections such that a free deployment rotation occurs between individual ladder sections in a vertical direction while eliminating swivel motion between individual ladder sections in all other directions except vertical. Another preferred embodiment of the invention utilizes curvature of the top portion of the top ladder section to form an enlarged bent hook to be used as hand rails during the initial descent from the window frame to the ladder.

BRIEF DESCRIPTION OF THE DRAWINGS

The invention may be understood and further advantages and uses thereof more readily apparent, when considered in view of the following detailed description of the exemplary embodiments, taken with the accompanying drawings in which:

FIG. 5 also illustrates a stand-off bar that prevents the moveable ladder sections from swinging past the vertical position so as not to hit the dwelling upon deployment;

FIG. 7 also illustrates the double swivel means between the side rails of ladder sections for folding around the moveable stand-off bar;

DESCRIPTION OF THE PREFERRED EMBODIMENTS

Figure 1:
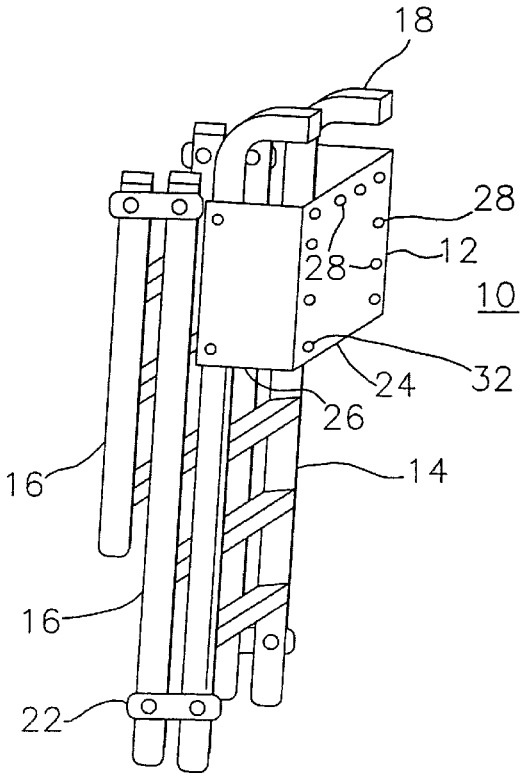
FIG. 1 is an isometric view of the emergency escape folding ladder constructed according to the teachings of the invention illustrating the attachment means for permanently affixing the emergency escape folding ladder to a window sill.

Referring now to the drawings and to FIG. 1 in particular, there is shown an isometric view of the emergency escape folding ladder 10 constructed according to the teachings of the invention illustrating the attachment means 12 for permanently affixing the emergency escape folding ladder to a window sill. Emergency escape folding ladder 10 further includes a first permanently affixed ladder section 14, foldable, movable ladder sections 16, hand rails 18, and swivel links 20. Attachment means 12 includes rigid facing plate 24 and stand-off plate 26 which may be formed of a rigid permanently affixing material such as for instance wood, fiberglass reinforced resin, and most suitably steel or other fire resistant material. Disposed in facing plate 24 are a multiplicity of apertures 28 which apertures are disposed in facing plate 24 so as to be in juxtaposition arrangement with the window frame stud and sill joist (not shown) that are disposed within external walls of residential structures at the location of course of the windows and other openings. The apertures 28 illustrated would line up with the structural inner wall stud and joist members along the left-hand side of a window in a residential structure. It can easily be appreciated that apertures 32 could also be disposed through facing plate 24 so as to line up with the structural inner wall stud and joist members along the right-hand side of a window in a residential structure.

Figure 2:
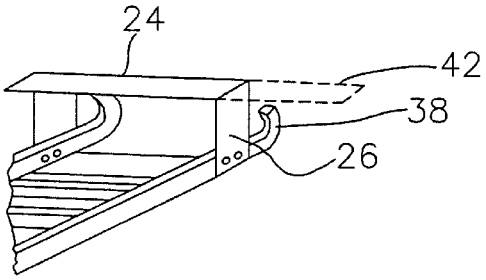
FIG. 2 is an isometric view of the first ladder section illustrating from a different perspective the attachment means for permanently affixing the emergency escape folding ladder to a window sill.

Referring now to FIG. 2 there is illustrated an isometric view of the first ladder section 14 illustrating from a different perspective the attachment means 12 for permanently affixing the emergency escape folding ladder to a window sill. FIG. 2 illustrates more clearly the function of stand-off plates 26 which is to permanently affix first ladder section 14 a predetermined distance away from the residential structure (not shown) which may be for example 14 inches. Side rail 34 and rungs 36 comprise the remainder of first ladder section 14. Please note that the top portion 38 of side rail 34 is bent forward and downward toward facing plate 24 so as to provide a handhold for any escapee user of emergency escape folding ladder 10. Please also note that facing plate 24 may include extension 42 which is drawn in phantom in FIG. 2 so that facing plate 24 extends the total width of the residential structure window (not shown). Extension 42 would also have apertures 28 disposed therethrough and it can be readily understood that this time facing plate 24 with extension plate 42 would juxtapose apertures 32 with the studs disposed in an exterior wall of the residential structure window (not shown).

Figure 3:
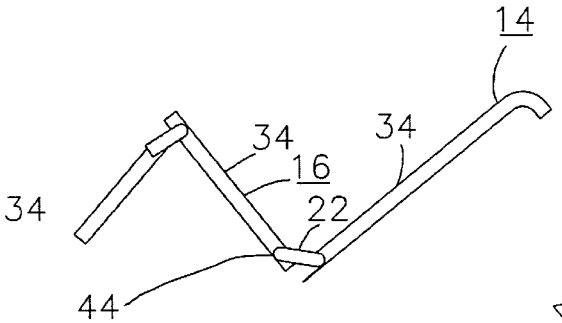
FIG. 3 is an elevational view of only the multiple ladder section side rails as the ladder is being deployed illustrating the multiplicity of swivel link means for joining the multiplicity of ladder sections to one another, wherein the swivel links have discreet lengths having apertures that line up and cooperate with apertures disposed in the side rails of individual ladder sections.

Referring now to FIG. 3 there is shown an elevational view of only the multiple ladder section side rails 34 as the ladder is being deployed illustrating the multiplicity of swivel link means 20 for joining the multiplicity of ladder sections 14,16 to one another. The swivel links 20 have discreet lengths having apertures 44 that line up and cooperate with apertures disposed in the side rails 34 of individual ladder sections 14,16 so that a standard rotatable fastener such as a bolt, rivet, pin etc. may be fed through the apertures and secure the side rails 34 to one another.

Figure 4:
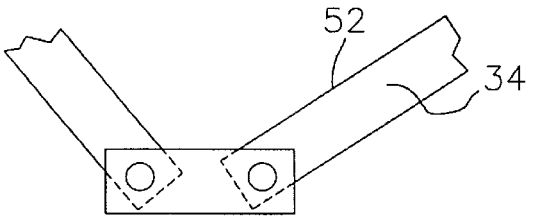
FIG. 4 is a detailed view of one of the swivel link means of FIG. 3, illustrating how the swivel links separate the individual ladder sections to provide for positive swivel free opening of the ladder sections relative to one another.

Referring now to FIG. 4 there is shown a detailed view of one of the swivel link means of FIG. 3, illustrating how the swivel links 20 separate the individual ladder sections 14,16 to provide for positive swivel free opening of the ladder sections relative to one another. This occurs because if the bolt/rivet/fastener/etc. apertures 44 through the side rails 34 are a distance x from the end of the rail 48, and a distance y from the side 52 of side rail 34 then the ladder sections 14,16 will open uninhibitively if the distance w between apertures 44 in swivel links 20 is greater than 2 times the square root of $x^2+y^2$. There is no need for the ends 48 of side rails 14,16 to be chamfered or beveled in any manner.

Figure 5:
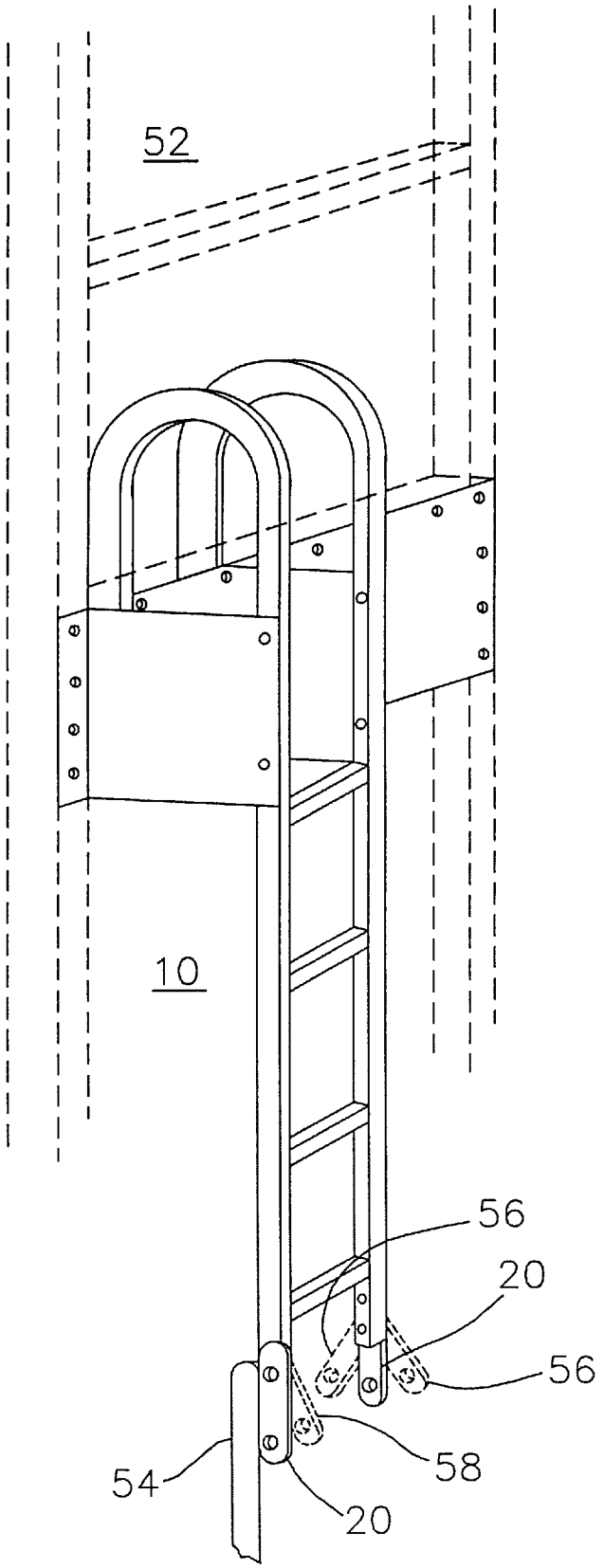
FIG. 5 is an isometric view of the emergency escape folding ladder constructed according to the teachings of the invention illustrating the attachment means for permanently affixing the emergency escape folding ladder to a window sill and a phantom view of the rough stud construction of the periphery of a window that is present inside the outer walls of residential dwellings.

Referring now to FIG. 5 there is shown an isometric view of the emergency escape folding ladder 10 constructed according to the teachings of the invention illustrating the attachment means 12 for permanently affixing the emergency escape folding ladder to a window sill and a phantom view of the rough stud construction 52 of the periphery of a window that is present inside the outer walls of residential dwellings. FIG. 5 also illustrates a fixed stand-off bar 54 that prevents swivel link 20 and thereby the moveable ladder sections 16 from swinging past the vertical position so as not to hit the dwelling upon deployment. Compare fixed stand-off bar 54 when it stops swivel link 20 on the left to an unrestrained swivel link 20 on the right. The phantom links 56,58 show both the unrestrained and the restrained movements of the swivel links 20, respectively.

Figure 6:
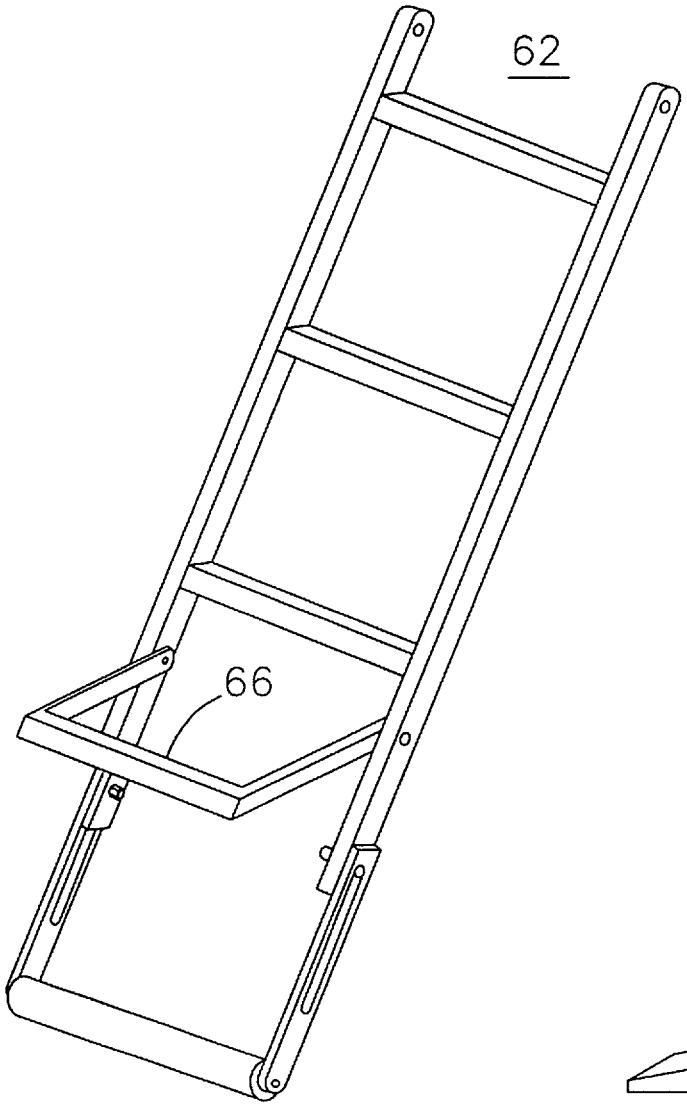
FIG. 6 is an isometric view of the emergency escape folding ladder constructed according to the teachings of the invention illustrating the bottom ladder section which has a downward-extending moveable securing means and FIG. 6 also illustrates the pivoting bottom rung directly above the roller lock securing means.

Referring now to FIG. 6 there is shown an isometric view of the emergency escape folding ladder 10 constructed according to the teachings of the invention illustrating a bottom ladder section which has a downward-extending moveable roller lock securing means 64. FIG. 6 also illustrates the pivoting bottom rung 66 directly above the roller lock securing means 64. During deployment, moveable roller lock securing means 64 drops downward while rolling along the ground level, and pivoting bottom rung 66 swings downward to provide a bottom step above ground level.

Figure 7:
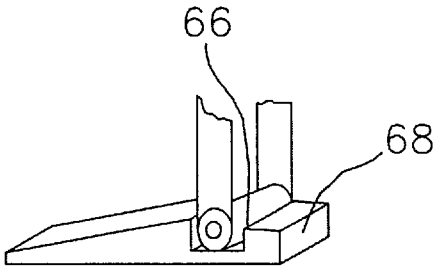
FIG. 7 is the roller locking plate that would be affixed to ground level.

Referring now to FIG. 7 there is shown the roller locking plate 68 that would be affixed to ground level and acts to receive and stabilize moveable roller lock securing means 64.

Figure 8:
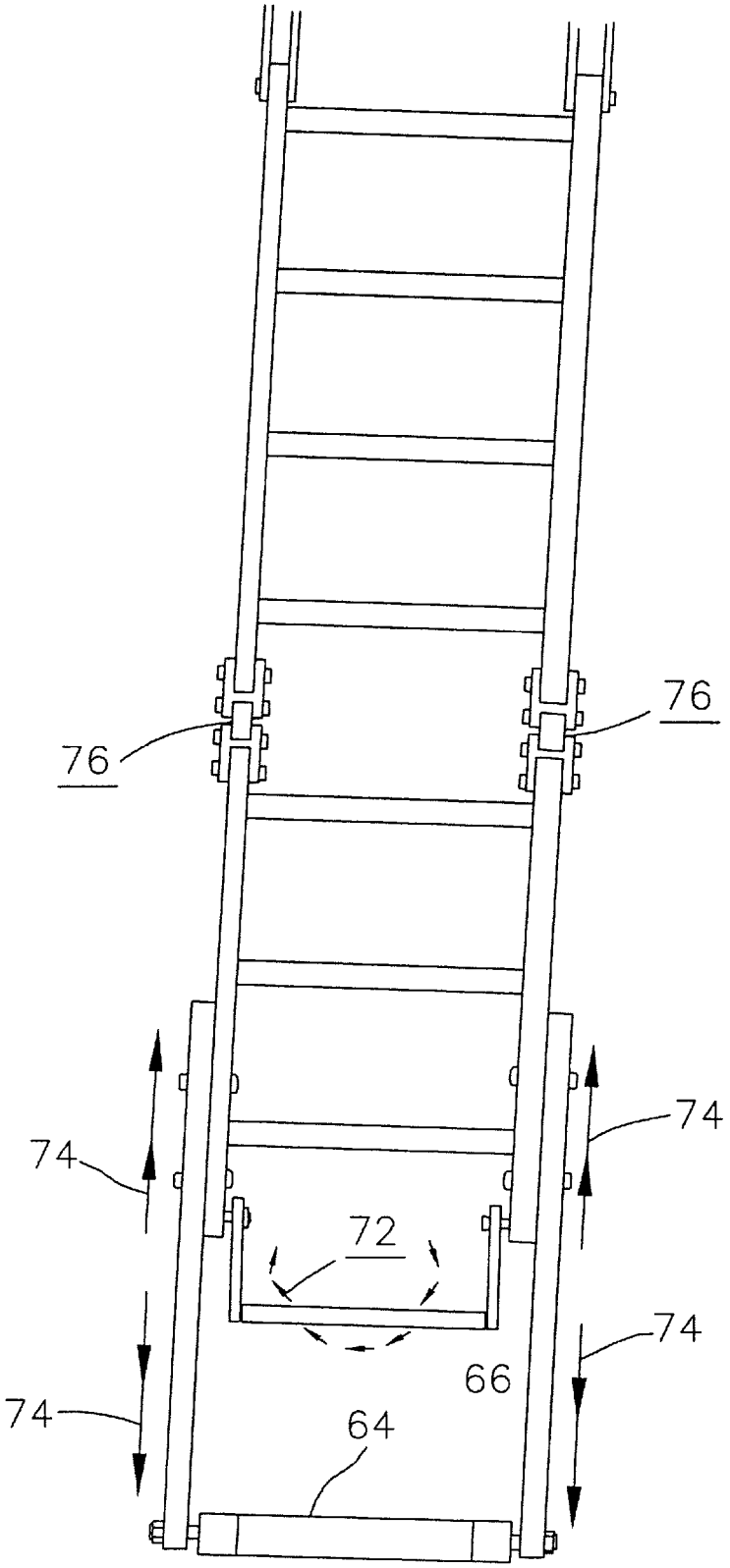
FIG. 8 is another isometric view of the bottom ladder section of FIG. 6 illustrating the pivoting bottom rung and the lock roller extension.

Referring now to FIG. 8 there is shown another isometric view of the bottom ladder section of FIG. 6 illustrating the pivoting bottom rung 66 and the lock roller extension 64 and their respective movement arrows 72,74. FIG. 8 also illustrates the double swivel means 76 between the side rails of ladder sections for folding around a moveable stand-off bar 78(shown in FIG. 9).

Figure 9:
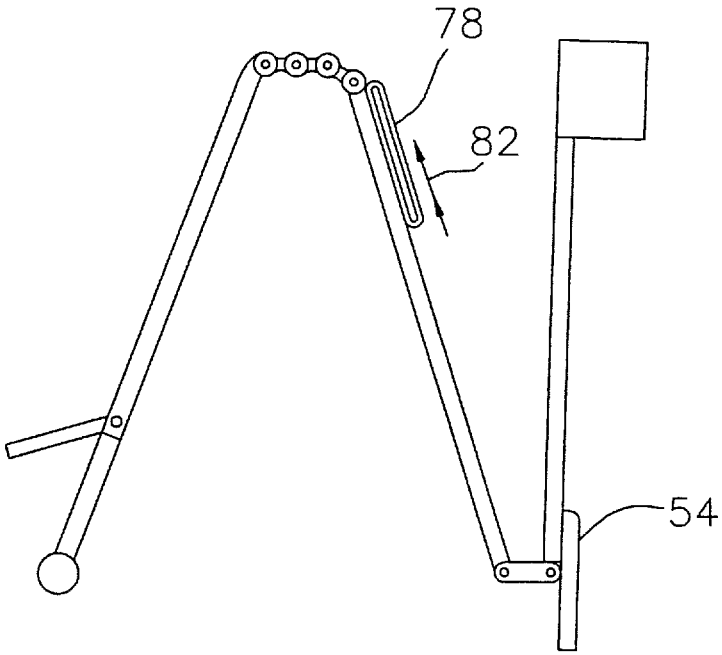
FIG. 9 is a side plan view of the emergency escape folding ladder during deployment.
Figure 10:
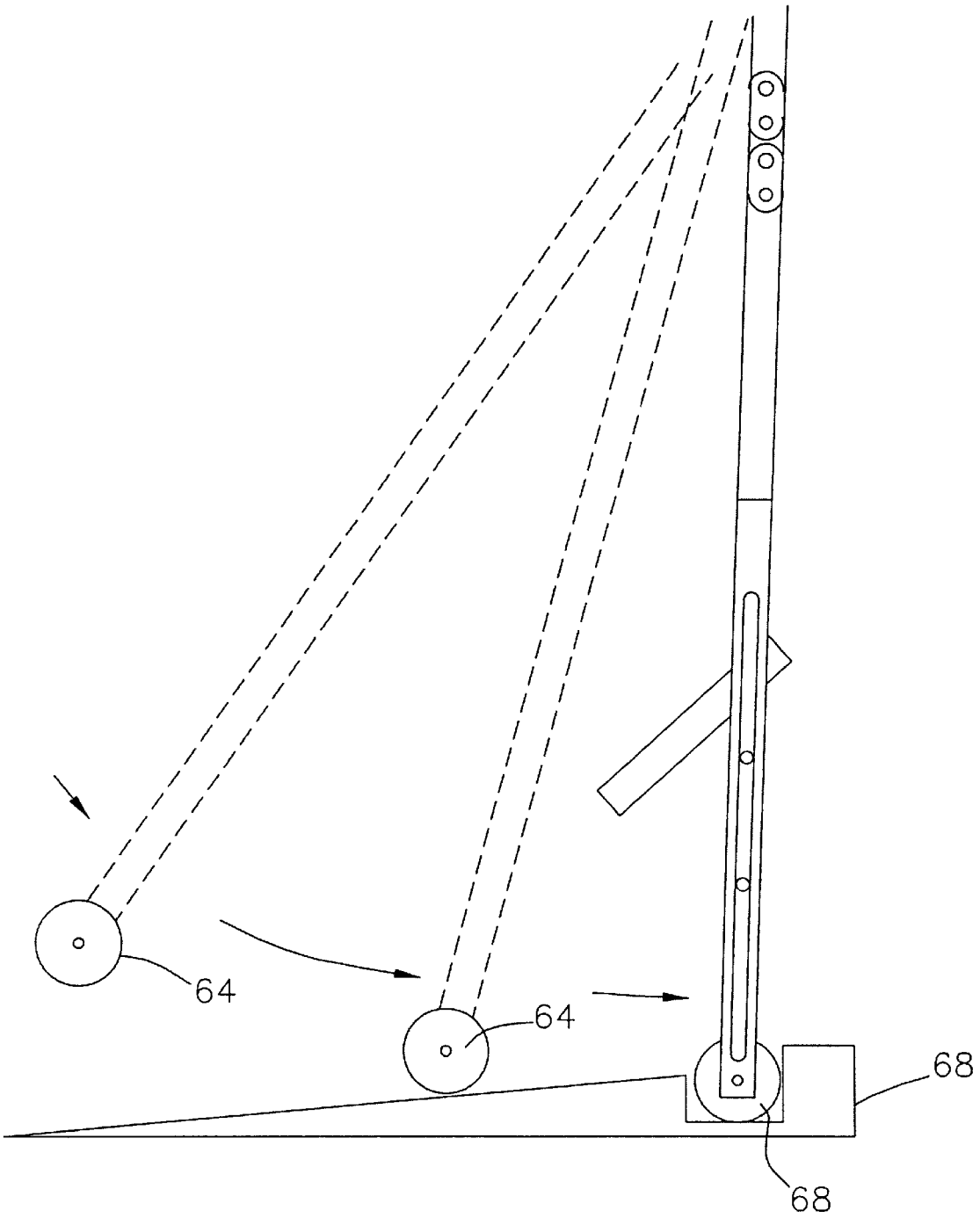
FIG. 10 is a side plan view of the emergency escape folding ladder during deployment and after deployment is completed.

Referring now to FIG. 9 there is shown a side plan view of the emergency escape folding ladder 10 during deployment illustrating fixed stand off bar 54 and movable stand off bar 78 and the movement arrows 82 of movable stand off bar 78. Referring now to FIG. 10 there is shown a side plan view of the emergency escape folding ladder during deployment and after deployment is completed illustrating the movement of moveable roller lock securing means 64 as it drops downward and rolls into moveable roller lock securing means receptacle 68.

Figure 11:
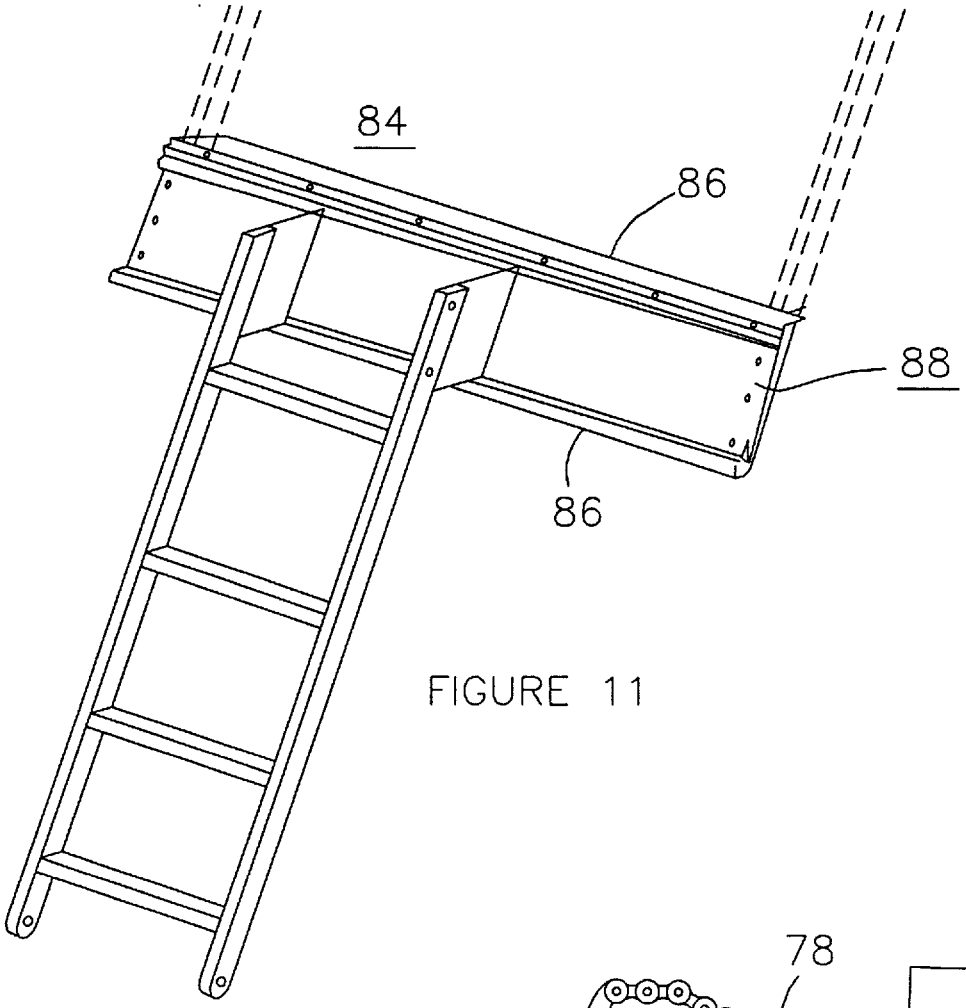
FIG. 11 is an isometric view of the emergency escape folding ladder illustrating how the first fixed ladder section may adjust in position along an elongated attachment plate.

Referring now to FIG. 11 there is shown an isometric view of the emergency escape folding ladder 10 illustrating how the first fixed ladder section 14 may adjust in position along an elongated attachment plate 84 by means of slots 86 receiving flat sliding plate 88.

Figure 12:
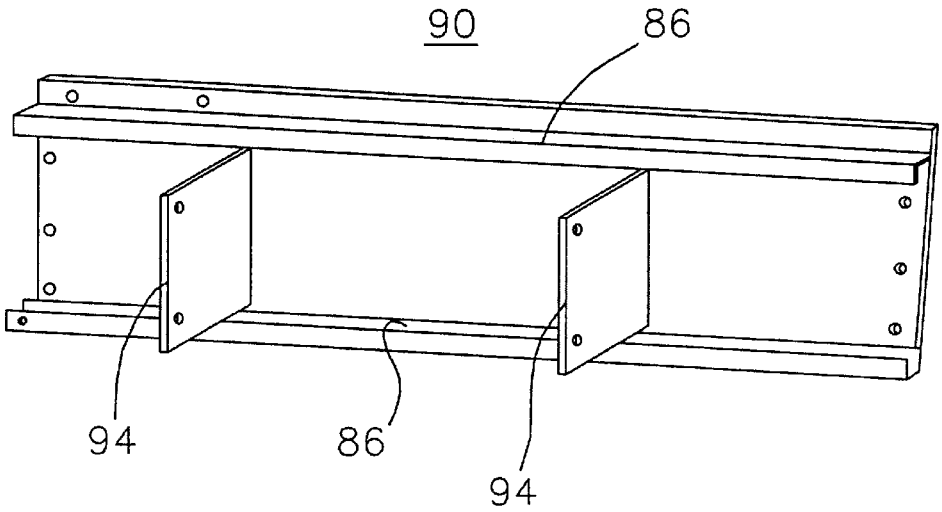
FIGS. 12 and 13 are isometric views of the moveable attachment means details illustrating how the attachment means for permanently affixing the emergency escape folding ladder to a window sill may be made moveable within a bottom window sill attachment plate.
Figure 13:
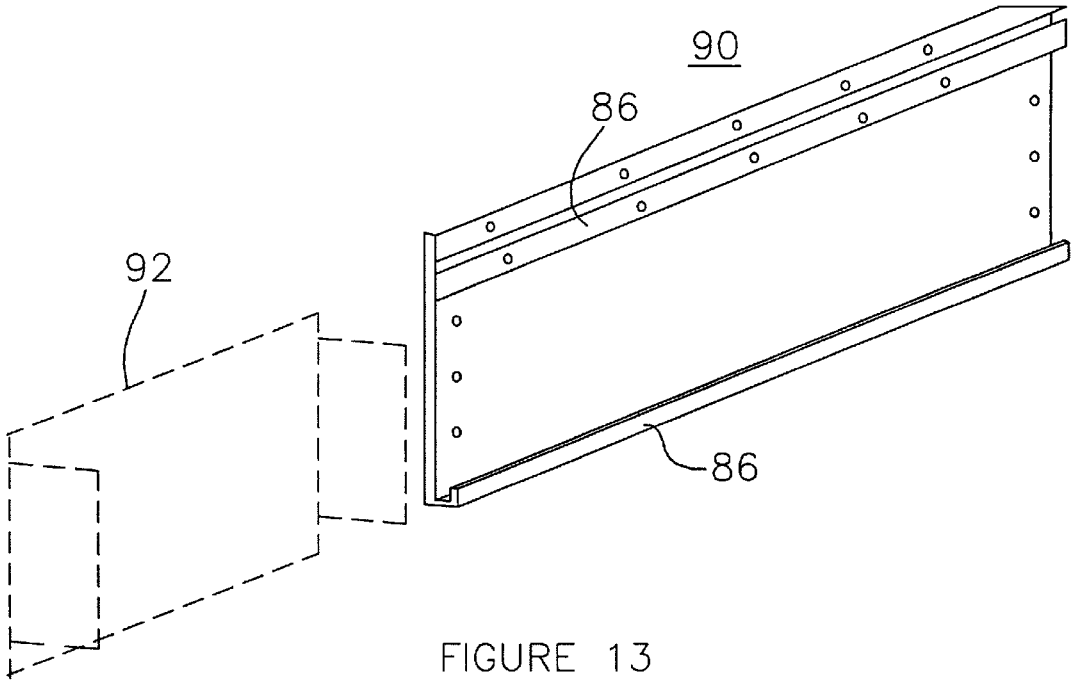

Referring now to FIGS. 12 and 13 there are shown isometric views of the moveable attachment means details illustrating how the attachment means 90 for permanently affixing the emergency escape folding ladder 10 to a window sill may be made moveable within a bottom window sill attachment plate 92 moving and restrained within slots 86. Alternately fixed ladder attachment plates 94 may slide directly within slots 86 to thereby adjust accommodate differing widths of emergency escape ladders 10.

Figure 14:
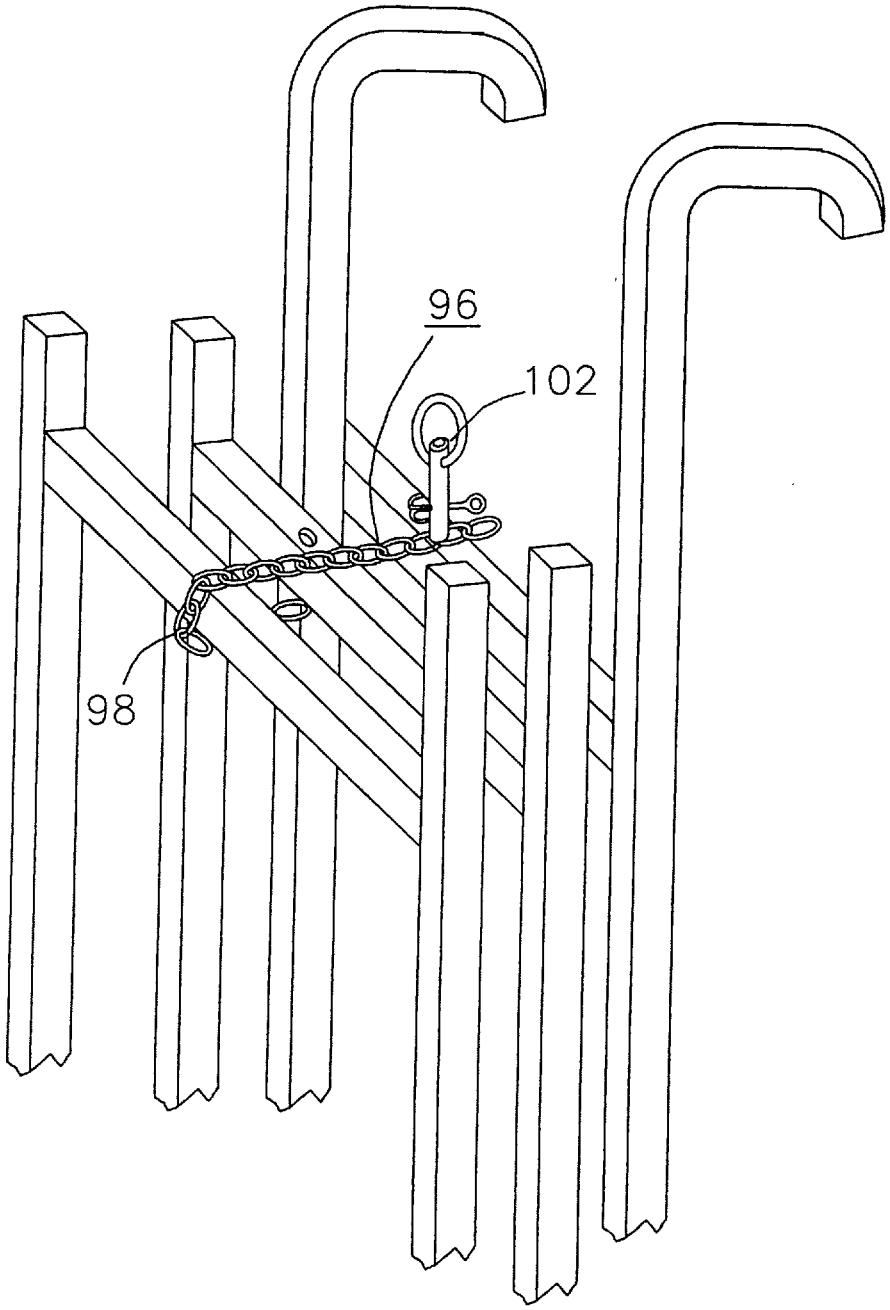
FIG. 14 is an isometric view of the emergency escape folding ladder showing a chain gathering means for retaining the moveable ladder sections in the upright collapsed position.

Referring now to FIG. 14 there is shown an isometric view of the emergency escape folding ladder 10 showing a chain gathering means 96 for retaining the moveable ladder 16 sections in the upright collapsed position. Chain gathering means 96 includes chain 98 and release pin 102

Figure 16:
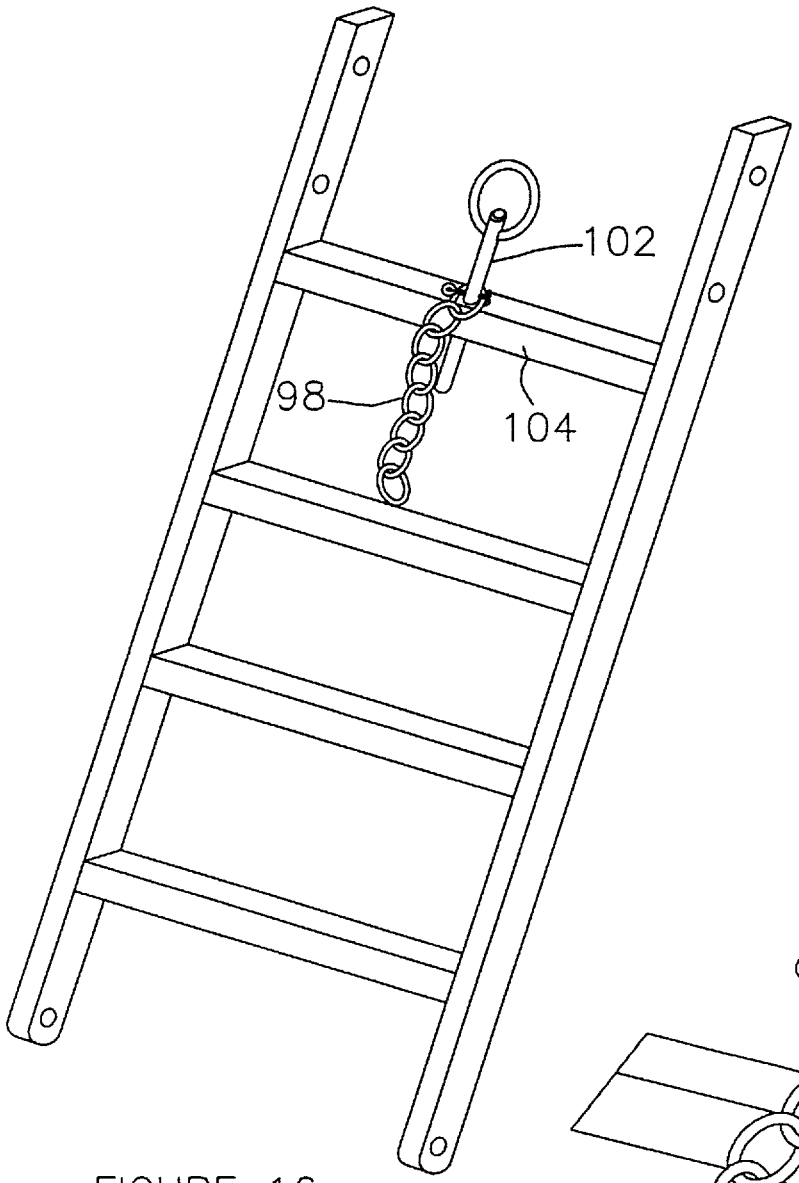
FIGS. 15 and 16 are detailed views showing the chain gathering means.
Figure 15:
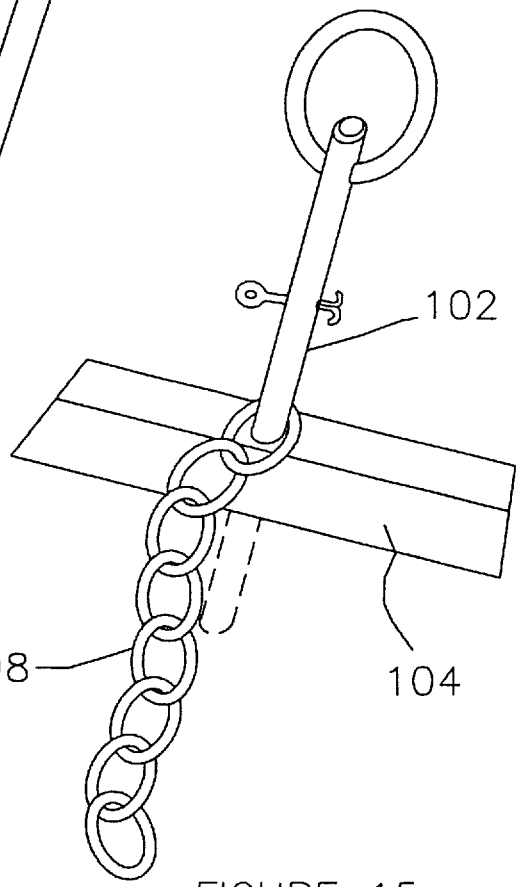

Referring now to FIGS. 15 and 16 there are shown detailed views showing the chain gathering means 96. When release pin 102 is pulled from ladder horizontal rung 104, then the movable ladder sections 16 are deployed.

Figure 17:
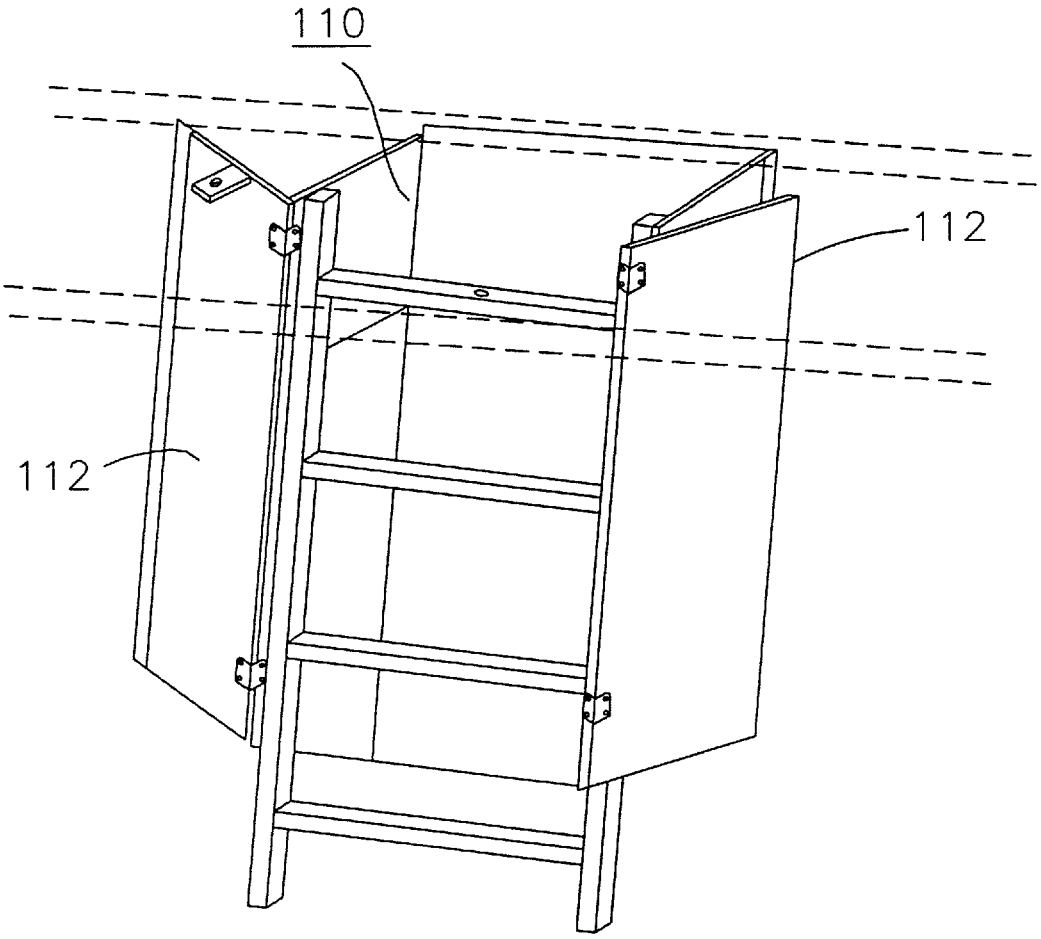
FIGS. 17, 18 and 19 are isometric views illustrating a collapsed position securing box for holding the moveable ladder sections in the folded collapsed position and also for cosmetic purposes.
Figure 18:
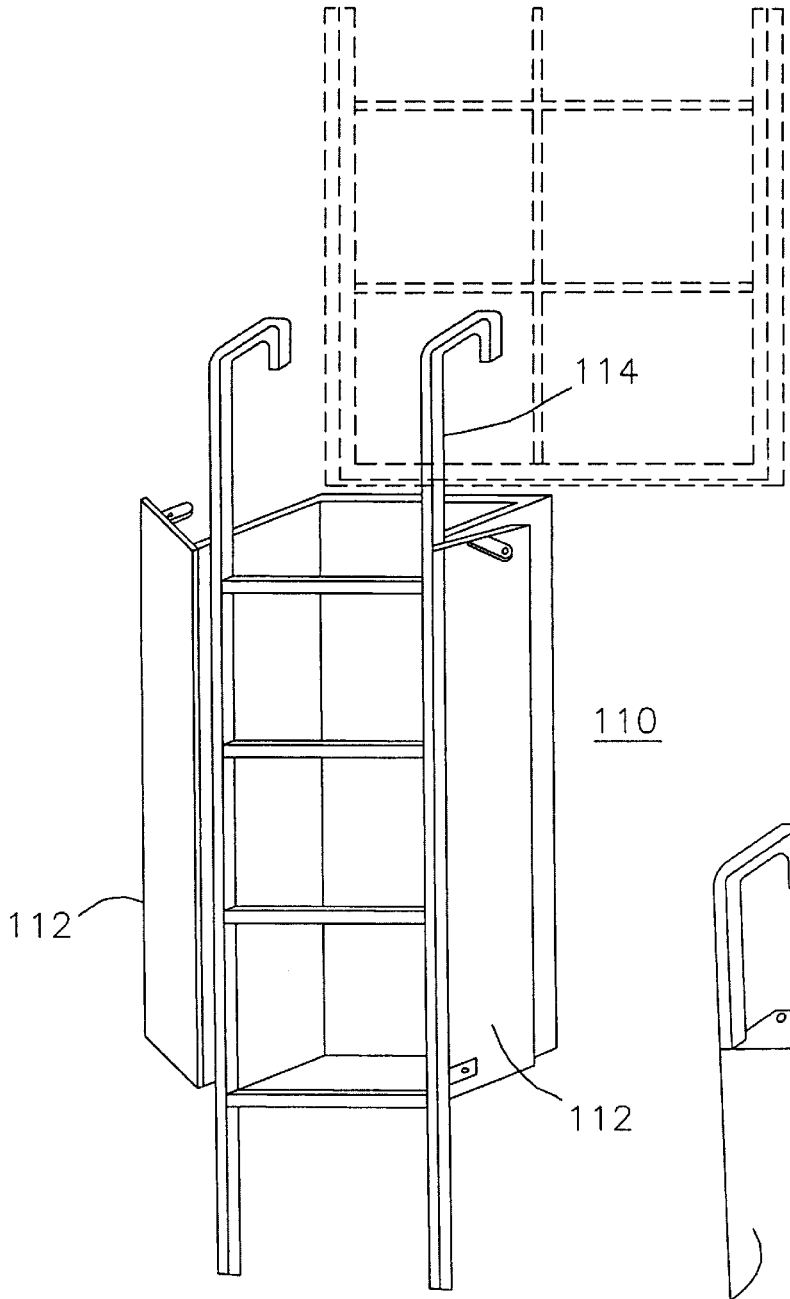
Figure 19:
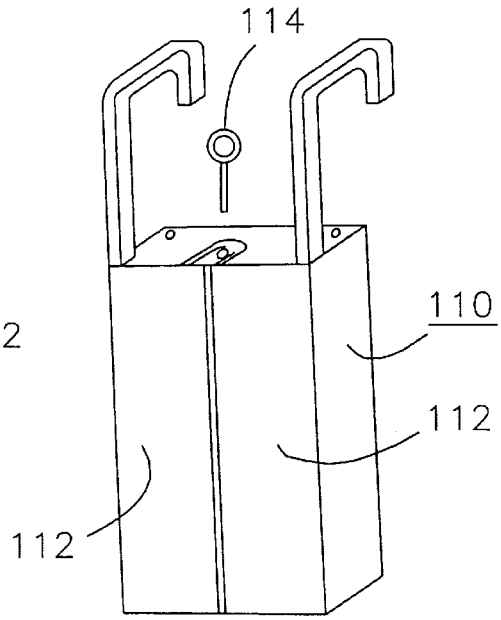

Referring now to FIGS. 17, 18 and 19 there are shown isometric views illustrating a collapsed position securing box 110 for holding the moveable ladder sections 16 in the folded collapsed position and also for cosmetic purposes. Spring loaded doors 112 release and deploy movable ladder sections 16 when pin 114 is pulled.

Figure 20:
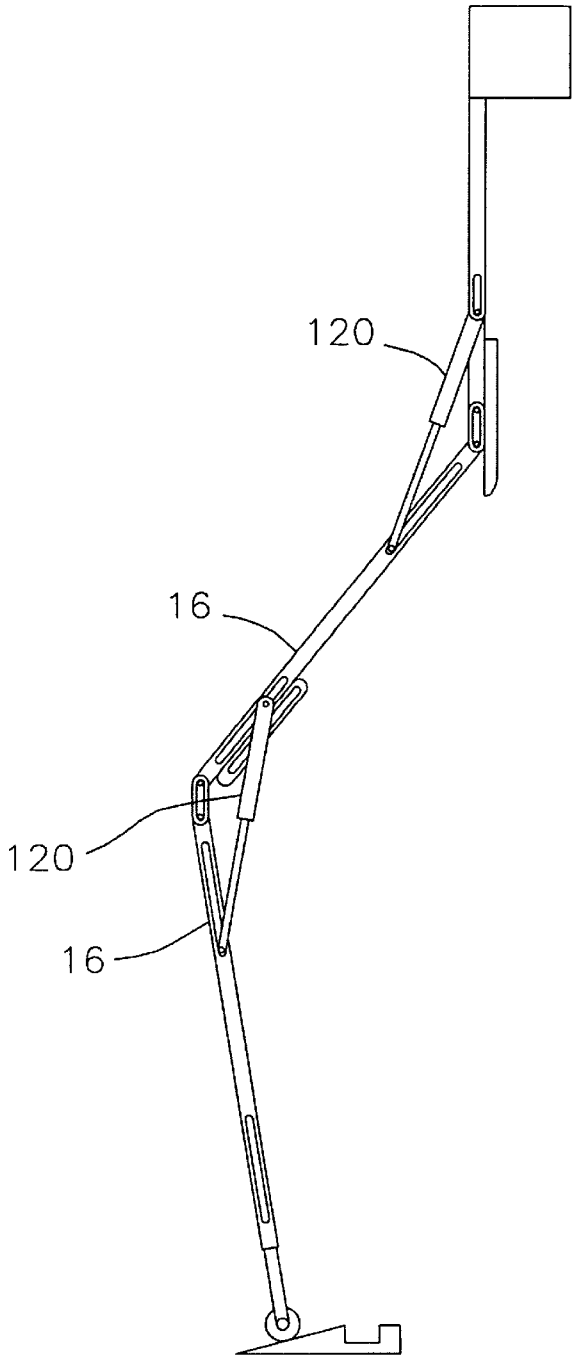
FIGS. 20 and 21 are side views of the emergency escape folding ladder illustrating how shock absorber means may be affixed between ladder sections to ensure a cushioned drop of the emergency escape folding ladder during deployment.
Figure 21:
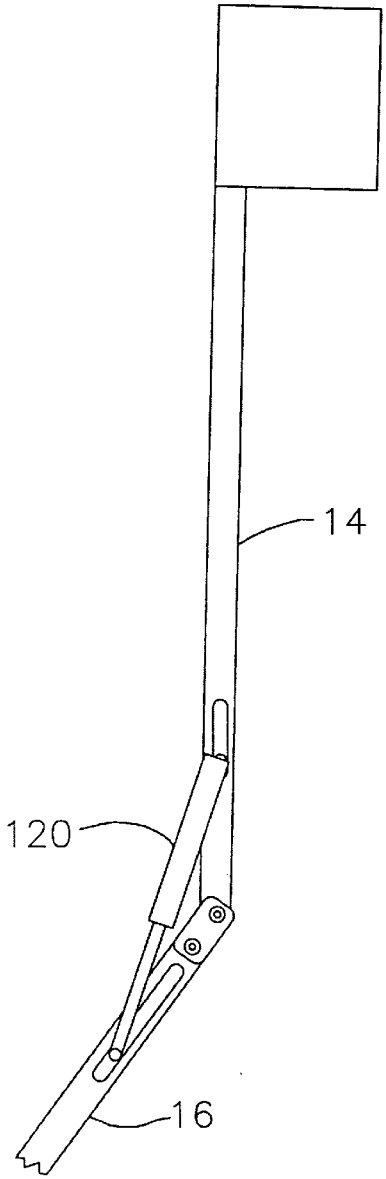

Referring now to FIGS. 20 and 21 there are shown side views of the emergency escape folding ladder 10 illustrating how shock absorber means 120 may be affixed between ladder sections to ensure a cushioned drop of the emergency escape folding ladder movable sections 16 during deployment.

I claim:

1. An emergency escape folding ladder, comprising:

a) at least two ladder sections, each including longitudinal extending side rails and a multiplicity of foot rungs disposed in rigid mechanical attachment to and extending between said side rails in spaced relationship; and b) swivel link means including a link disposed in rotatable attachment to the ends of side rails of the ladder sections for separating the individual ladder sections and for rotational opening of the ladder sections relative to one another;

said side rails each having an end and a front and rear side and including a stand off bar comprising a rigid bar rigidly disposed longitudinally on the rear side of the side rail near to and extending past said side rail end at least a distance necessary to provide an abutment for the link and an adjacent longitudinal extending side rail preventing said link and said longitudinal extending side rail from swinging past said stand off bar thereby preventing the movable ladder sections from moving past a vertical position.

2. The emergency escape folding ladder of claim 1 further including attachment means for permanently affixing at least one of the ladder sections to the inner wall structural members of a window frame.

3. The emergency escape folding ladder of claim 2 further including a retention means disposed on said attachment means for securing the ladder sections in the folded position.

4. The emergency escape folding ladder of claim 2 further including a roller extension means for affixing and attaching the bottom movable ladder section to ground level.

5. The emergency escape folding ladder of claim 2 further including a pivotable bottom step means for folding up and pivoting down upon deployment of the bottom ladder section.

6. The emergency escape folding ladder of claim 2 further including a movable stand off bar means for preventing the movable ladder sections from moving past the vertical position.

7. The emergency escape folding ladder of claim 6 further including a double hinged swing link means for folding around said movable stand off bar means for preventing the movable ladder sections from moving past the vertical position.

8. The emergency escape folding ladder of claim 2 further including a movable attachment means for adjustable location of the folding emergency escape ladder prior to attachment.

9. The emergency escape folding ladder of claim 2 further including a pin pull means for deployment of the folding emergency escape ladder.

10. The emergency escape folding ladder of claim 2 further including a folding pin release cabinet means for holding the moveable ladder sections in the folded collapsed position and also for cosmetic purposes.

* * * * *